US007170969B1

(12) United States Patent
Yun et al.

(10) Patent No.: US 7,170,969 B1
(45) Date of Patent: Jan. 30, 2007

(54) X-RAY MICROSCOPE CAPILLARY CONDENSER SYSTEM

(75) Inventors: Wenbing Yun, Walnut Creek, CA (US); Frederick William Duewer, Albany, CA (US); Yuxin Wang, Arlington Heights, IL (US)

(73) Assignee: Xradia, Inc., Concord, CA (US)

( * ) Notice: Subject to any disclaimer, the term of this patent is extended or adjusted under 35 U.S.C. 154(b) by 0 days.

(21) Appl. No.: 10/704,381

(22) Filed: Nov. 7, 2003

(51) Int. Cl.
*G21K 7/00* (2006.01)

(52) U.S. Cl. ..... 378/43

(58) Field of Classification Search ..... 378/43, 378/70, 84, 85, 145; 359/838
See application file for complete search history.

(56) References Cited

U.S. PATENT DOCUMENTS

| | | | | |
|---|---|---|---|---|
| 5,044,001 | A * | 8/1991 | Wang | 378/43 |
| 5,222,113 | A * | 6/1993 | Thieme et al. | 378/43 |
| 5,311,565 | A * | 5/1994 | Horikawa | 378/43 |
| 5,550,887 | A * | 8/1996 | Schmal et al. | 378/43 |
| 5,682,415 | A * | 10/1997 | O'Hara | 378/147 |
| 5,744,813 | A * | 4/1998 | Kumakhov | 250/505.1 |
| 6,128,364 | A * | 10/2000 | Niemann | 378/43 |
| 6,167,112 | A * | 12/2000 | Schneider | 378/43 |
| 6,278,764 | B1 * | 8/2001 | Barbee, Jr. et al. | 378/84 |
| 6,389,107 | B1 * | 5/2002 | Kantsyrev et al. | 378/145 |
| 6,442,231 | B1 * | 8/2002 | O'Hara | 378/84 |
| 6,504,901 | B1 * | 1/2003 | Loxley et al. | 378/84 |
| 2001/0046276 | A1 * | 11/2001 | Schneider et al. | 378/43 |
| 2004/0125442 | A1 * | 7/2004 | Yun et al. | 359/386 |

FOREIGN PATENT DOCUMENTS

| | | | |
|---|---|---|---|
| JP | 63192000 | A * | 8/1988 |
| JP | 01292297 | A * | 11/1989 |

OTHER PUBLICATIONS

Cheng et al., "X-ray Microscopy: Instrumentation and Biological Applications", 1987, Springer-Verlag, pp. 232 and 237.*

* cited by examiner

*Primary Examiner*—Edward J. Glick
*Assistant Examiner*—Chih-Cheng Glen Kao
(74) *Attorney, Agent, or Firm*—Houston Eliseeva LLP

(57) ABSTRACT

A radiation condenser system for an X-ray microscope allows for the efficient collection and relay of radiation from a source to the sample. It generates a converging hollow cone of radiation that can be used in the imaging of a sample or target using a zone plate lens. This system comprises a capillary tube for receiving and focusing radiation onto a sample. A center stop is provided for blocking radiation being transmitted along an axis of the capillary tube.

10 Claims, 2 Drawing Sheets

X-RAY MICROSCOPE CAPILLARY CONDENSER SYSTEM

BACKGROUND OF THE INVENTION

X-ray microscopy is typically performed in synchrotrons. Synchrotrons are a good source for X-ray radiation. They produce spectrally pure, powerful, and highly collimated beams.

X-ray radiation has many advantages for imaging. The short wavelength enables very high resolutions. The penetrating nature of X-ray radiation enables the imaging of internal structures in semiconductor devices, for example. This characteristic can be very useful in the assessment of fabrication processes, for example.

Unfortunately, these synchrotrons are not available to many commercial institutions because of limited access to beam lines. Furthermore, the condensers used for the synchrotron-based x-ray microscopes typically have either a limited efficiency or inadequate imaging properties.

Laboratory sources are another option. These devices are typically based on electron bombardment of a target. Here, however, highly efficient optical trains are required to concentrate the weaker, diverging beams from these devices.

Various systems exist for concentrating X-ray radiation. Often, elliptical reflective surfaces are used. A source is located at one focal point of the ellipsis, defined by the surface, and the object of interest is located at the other focal point. Many times, these are off-axis devices making alignment difficult since the elliptical surface must be angularly and positionally aligned to an otherwise arbitrary position off of the optical axis.

Capillary tube concentrators have also been described in the prior art for concentrating X-ray radiation. These, in some cases, are manufactured by the mandrel method, in which a metal bar is selectively etched and then glass coated. Subsequently, the metal bar is removed. Often, these concentrators are either conically or elliptically shaped. They are used typically to collimate the light from a point X-ray source.

SUMMARY OF THE INVENTION

The present invention is directed to a radiation condenser system for an X-ray microscope. It allows for the efficient collection and relay of radiation from a source to the sample. It generates a converging hollow cone of radiation that can be used in the imaging of a sample or target using an objective lens, such as a zone plate lens. It can be designed for bright-field imaging, phase contrast, and dark-field imaging modes.

The condenser is important to an x-ray imaging microscope using laboratory x-ray sources, especially for sources with a source size smaller or of similar dimensions of the field of view of the imaging system. In such cases, the condenser allows effective collection of x-rays from the source and achieves a desired illumination condition for properly illuminating the object to achieve either high resolution or a desired imaging contrast method, such as bright-field, Zernike phase contrast, or dark-field.

Without using a condenser system, for practical x-ray sources and realizable zone plates, one of two undesirable situations occurs. (For reference, with 45 nanometer outermost zones, zone plates illuminated by laboratory sources producing 5.4 keV x-rays by a Cr target will start to encounter problems with chromatic aberration at an 80 micrometer diameter.) For an x-ray microscope using a zone plate as the objective, it is essential to produce a suitable hollow beam of illumination to avoid image contrast degradation of the image at the detector plane because of the presence of unwanted diffraction orders, especially the undiffracted zero order beam, within the image field which is conjugate of the field of the view. In the first case, for source diameters bigger than roughly the field of view of the x-ray microscope, a central stop can be used at a suitable location between the source and the object to produce an effective hollow cone beam of illumination to block the direct beam arriving at the imaging field on the detector which corresponds to the field of view. Here, source size is typically too big and the source brightness (defined as photons per unit source area, per unit solid angle, and per unit time) is low, which reduces the system throughput. In the second case, for source diameters smaller than the field of view, a central stop can not be used between the source and the object to block the direct beam and to form an useful hollow cone beam of illumination.

For optimal performance, the radiation condenser system should have a high efficiency (close to 100%). It should have sufficiently high imaging quality so that all available x-ray radiation collected by the condensing optics is directed to the region of interest. In general, the imaging quality of a condenser may be considered to be sufficiently good if its blurring to the focal spot is substantially less than the geometrical image of the source. The inventive grazing incidence capillary tube routinely exhibits greater than 90% efficiency and has an image blurring of preferably less than 10 micrometers.

In the preferred embodiment, the radiation condenser system has a numeric aperture comparable to the objective lens of the x-ray microscope. This improves the spatial resolution of the x-ray microscope when operating in a bright-field imaging mode.

The center stop is useful, especially in zone plate microscopes, to block the radiation along the optical axis. Zone plates are typically only about 20% efficient in focusing the radiation. As a result, a large amount of background radiation or noise is transmitted parallel to the optical axis and not diffracted by the zone plate. The center stop is used to block this radiation to thereby improve the signal to noise ratio of the system.

In the preferred embodiment, the radiation is generated by electron bombardment. In this embodiment, an electron gun is used to irradiate a metal target, such as chromium, gold, or tungsten, with an electron beam. This generates radiation that is then condensed and relayed by the condenser system to the sample.

In the preferred embodiment, the capillary tube has an elliptical, circularly symmetric (about the optical axis) curvature. The source is located at one focal point of the ellipse defined by the inner surface of the capillary tube. The sample is located at the other focal point. Therefore, radiation generated at the source is focused onto the sample.

In the preferred embodiment, the capillary tube's inner surface will efficiently reflect the radiation. This is typically a low-Z material such as a glass. The capillary tube is preferably made out of glass by heating and blowing of the glass to form the desired elliptical curvature of the condenser tube's inner wall.

In the preferred embodiment, a membrane is used for supporting the center stop along the axis of the capillary tube. Preferably, this membrane is bonded to the end of the capillary tube that is remote from the radiation source. Further, in the preferred embodiment, a pinhole stop is used between the source and the sample to further improve the signal to noise ratio by reducing background radiation levels.

In general, according to another aspect, the invention also features a zone plate microscope. This microscope comprises a capillary tube for receiving and focusing radiation onto a sample. A zone plate lens is used for collecting the radiation from the sample.

In the preferred embodiment, a center stop is used to improve the signal to noise ratio of the system. Moreover, to efficiently use the zone plate lens, i.e., to ensure that it is completely filled with the radiation relayed by the capillary tube, the numerical aperture of the capillary tube is matched to the zone plate lens.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
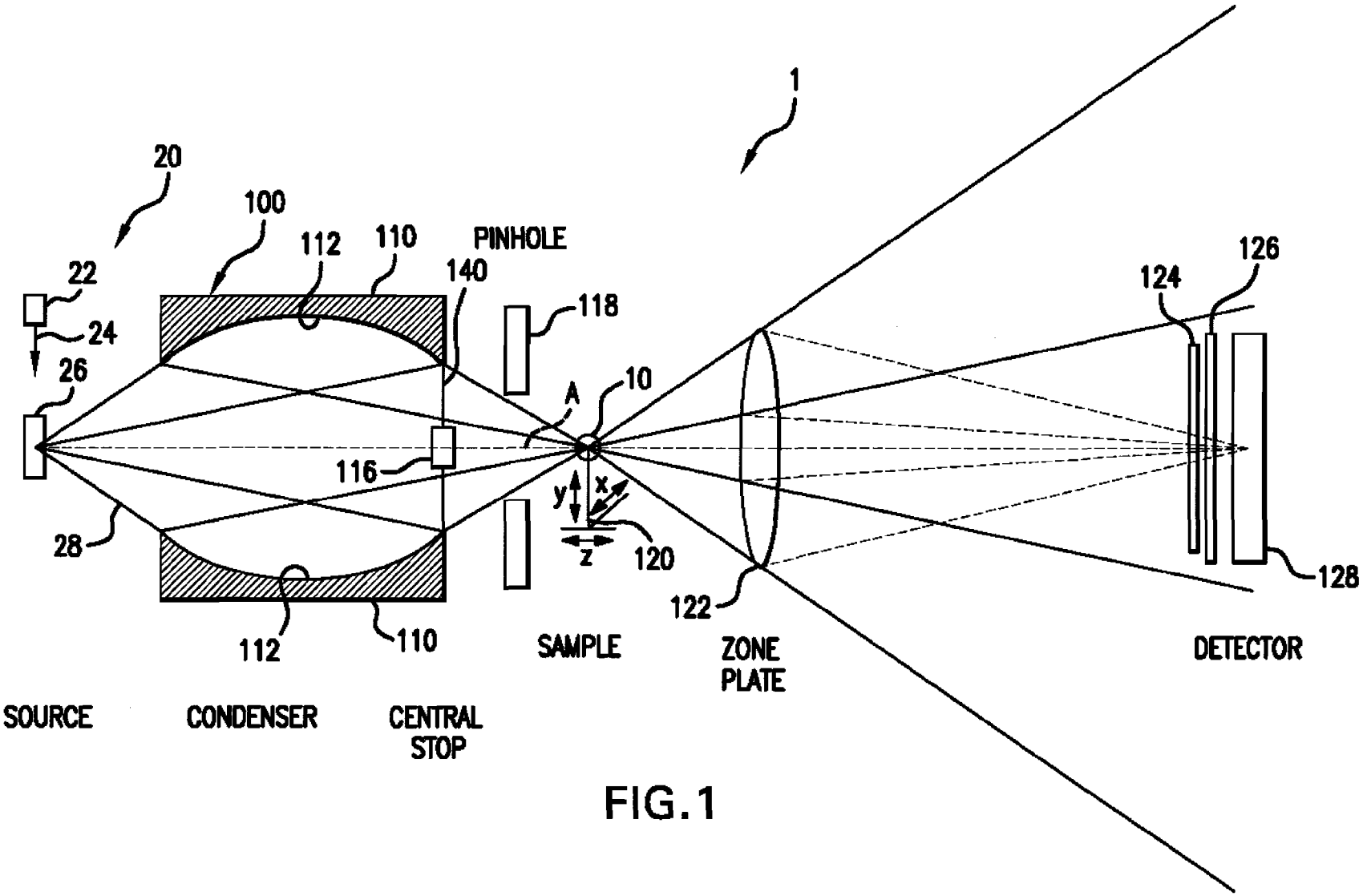
FIG. 1 is a cross-sectional view X-ray microscope according to the present invention.

FIG. 1 is a schematic diagram of an X-ray microscope 1 using a capillary condenser system 100, which has been constructed according to the principles of the present invention.

Specifically, in the current embodiment, an electron bombardment laboratory X-ray source 20 is used. These systems comprise an electron gun 22 that generates an electron beam 24 that is directed at a target 26. Typically, the target 26 is selected from the group of: chromium, tungsten, platinum, or gold.

This bombardment of the target 26 generates X-ray radiation 28 by the process of x-ray fluorescence. The radiation is emitted, typically at a 6–45 degree, take-off angle.

These laboratory sources, however, produce a relatively weak radiation beam as compared to stronger sources, such as synchrotrons. As a result, the condenser system 100 is required. According to the invention, a capillary tube-based system is used.

Specifically, the capillary tube 110 is preferably made out of a glass capillary tube that is circularly symmetric around the center optical axis A. This capillary tube 110 has been formed, such as by introducing a pressurized gas into the capillary tube 110, while heating it to soften the glass forming the tube. Preferably, the inner wall 112 is controlled to have an ellipsoidal curvature. The ellipsoidal surface 112 is controlled so that one of the focal points is coincident with the source 26, and the other with the sample 10.

In one embodiment, the inner wall 112 of the capillary tube condenser 110 is coated with a material that is reflective to the X-ray radiation beam 28. Typically, this is a high Z material, such as tungsten or gold. As a result, the radiation emitted by the source 20 is reflected due to the low angle of incidence on the inner surface 112 to enable the efficient relay of the radiation to the target 10.

The radiation is thus converted into a converging cone of radiation, directed at the sample 10. The sample 10 is preferably held on a stage 120, which allows for its controlled positioning along the optical axis A, or z-axis direction, and the x and y axes, which are orthogonal to the optical axis A.

Some of the radiation is absorbed or phase-shifted in the sample, whereas other radiation is transmitted completely through the sample 10. The transmitted radiation is received at a zone plate 122. This zone plate collects the diverging cone of radiation, and converts it into a converging hollow cone of radiation in the direction of a detector 128.

In the typical embodiment, an intervening scintillator 124 and optical system 126 are used. Generally, the scintillator 124 is required when the detector 128 was not responsive to the radiation generated by the source. This is especially common for shorter wavelength X-rays and hard X-rays. Charge coupled devices (CCDs) are not responsive to this form of radiation since it will pass entirely through the device. As a result, the scintillator 124 generates radiation in the optical wavelengths, which are then focused by the optical system 126 onto the detector 128, such as a CCD or film.

In zone plate systems, the radiation that is used to illuminate the sample 10 preferably has a hollow cone profile. That is, there is substantially no radiation being transmitted along the optical axis A. This is because zone plates are only approximately 20% efficient in diffracting radiation to the detector. Thus radiation traveling along the optical axis is dominated by undiffracted radiation, which carries little information about the sample 10. As a result, in the preferred embodiment, a center stop 116 is located between the source 20 and the detector 128. Preferably the center stop is located near or in the capillary optic 110. In the preferred embodiment, it is located at the capillary optics exit aperture.

In the preferred embodiment, the center stop 116 is attached to a membrane 140, which is transmissive to radiation, such as silicon nitride. This silicon nitride membrane is then adhered or bonded to the exit aperture of the capillary tube 110.

To further improve the signal to noise radio, a pinhole aperture 118 is preferably provided between the source 20 and the detector 128 to further decrease system background radiation.

The pinhole stop 118 is preferably located on a separate stage. In the preferred embodiment, the capillary optic is approximately 3 millimeters (mm) in diameter. The exit aperture is approximately 200 micrometers in diameter.

The numerical aperture of the condenser 110 preferably matched to the zone plate lens. The zone plate lens is thus fully filled and therefore, efficiently used.

In another embodiment, the radiation condenser system has a pupil aperture specially designed to illuminate part of the objective aperture to be used in the x-ray microscope operating in a phase-contrast imaging mode, such Zernike phase contrast. In this case, a phase plate is added to the X-ray optical train between the sample 10 and the detector 128. In one implementation the phase plate is added to the back focal plane of the zone plate 122, i.e., between the zone plate 122 and the detector 128.

In yet another embodiment, the radiation condenser system 100 has an annular shaped pupil of sufficiently large size such that the pupil of the objective 122 is smaller or equal to the inner part of the condenser annular pupil. This condenser is useful to make the x-ray microscope to operate in a dark-field imaging mode.

In other implementations, when the source size is equal to or larger than the field of view of the x-ray microscope, the condenser is used that images the source with an imaging conjugate of unity to minimize image aberration.

In still other implementations, where the source size is smaller than the field of view of the x-ray microscope, the condenser is used in a magnifying geometry to achieve suitable illumination of the object. This design allows the use of a source with a small source size which typically provides higher source brightness and thus typically higher throughput.

Figure 2:
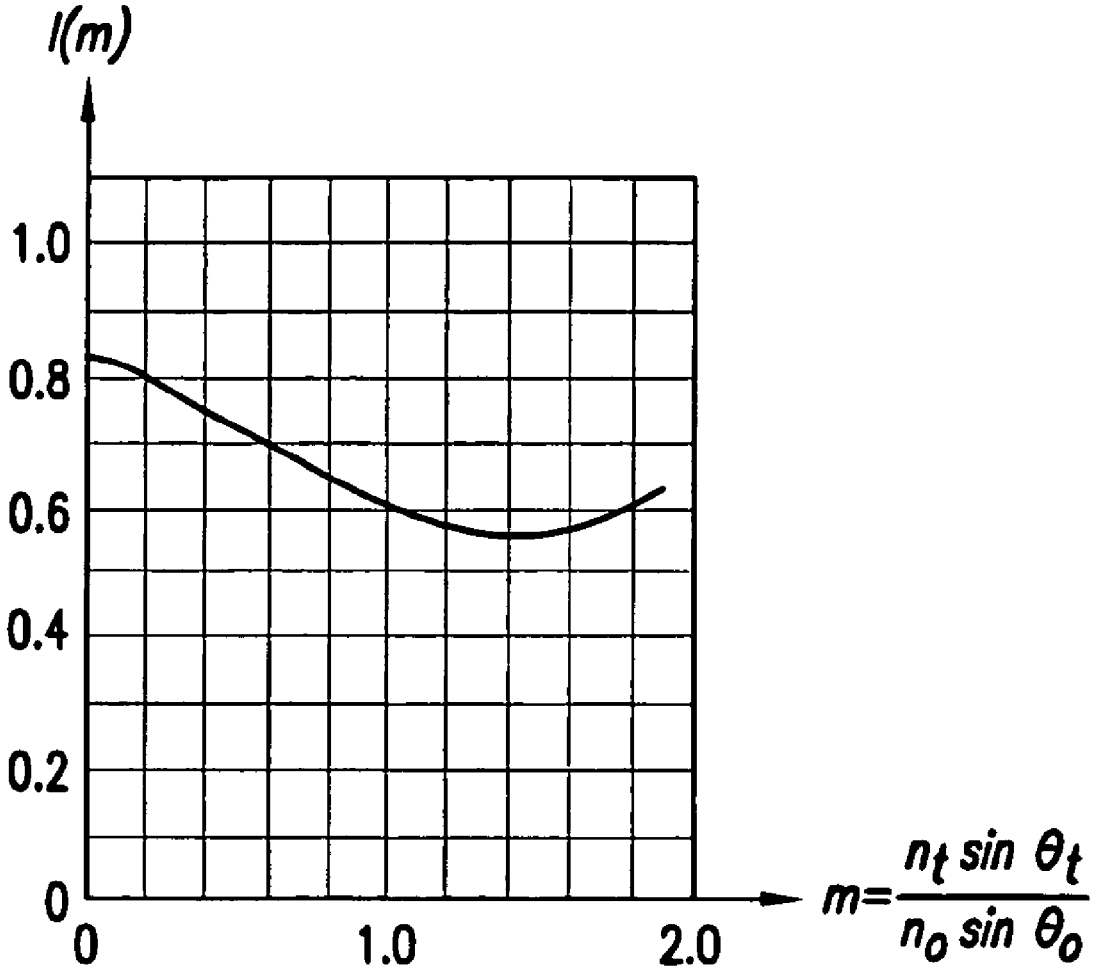
FIG. 2 is a plot illustrating the effect of the condenser aperture on the resolution of two pinholes of equal brightness, taken from H. H. Hopkins and P. M. Barham, Proc. Phys. Soc., 63 (1950).

FIG. 2 illustrates the importance of the NA of the condenser 100 matching the NA of the zone plate 122. The y-axis is the spatial resolution in units of $$\frac{\lambda}{NA_{obj}}.$$

The x-axis is $$\frac{NA_{cond}}{NA_{obj}}.$$

The spatial resolution limit of the x-ray microscope system reaches $$\frac{0.61\lambda}{NA_{obj}}$$

for $NA_{cond}=NA_{obj}$, where $\lambda$ is the wavelength of the x-ray radiation, $NA_{obj}$ is the numeric aperture of the zone plate lens, and $NA_{cond}$ is the numeric aperture of the radiation condenser system. The spatial resolution of the system worsens to about $$\frac{0.83\lambda}{NA_{obj}}$$

as $NA_{cond}$ zero. From the graph, the spatial resolution of the system improves slightly for $NA_{cond}>NA_{obj}$, but the image contrast decreases. Thus, the preferred embodiment, $$0.5 < \frac{NA_{cond}}{NA_{obj}} < 1.5.$$

However, in other cases, when the numerical aperture of the objective is larger than the maximum numerical aperture of a glass capillary condenser, the capillary tubes inner surface is coated with a material that will achieve a sufficiently large numerical aperture to match that of the objective for bright-field imaging mode, or suitably shaped condenser pupil for phase contrast imaging mode, or suitably and sufficiently large condenser pupil aperture for dark-field imaging mode. This is typically a high-Z material, such as gold, tungsten, or platinum. Here also, capillary tube is preferably made out of glass by heating and blowing of the glass to form the desired elliptical curvature of the condenser tube's inner wall.

In contrast, when the numerical aperture of the objective is larger than the maximum numerical aperture of a glass capillary condenser divided by the source magnification by the condenser, the capillary tubes inner surface is coated with a material that will achieve a sufficiently large numerical aperture to match that of the objective for bright-field imaging mode, or suitably shaped condenser pupil for phase contrast imaging mode, or suitably and sufficiently large condenser pupil aperture for dark-field imaging mode. This is typically a high-Z material, such as gold, tungsten, or platinum.

In yet another preferred embodiment where a larger condenser numerical aperture is required, the inner surface is a reflecting surface fabricated from multilayer, thin film mirror.

While this invention has been particularly shown and described with references to preferred embodiments thereof, it will be understood by those skilled in the art that various changes in form and details may be made therein without departing from the scope of the invention encompassed by the appended claims.

What is claimed is:

1. A zone plate microscope, comprising:

an electron bombardment source for generating x-ray radiation;

a single capillary tube, having an elliptical curvature, for receiving and focusing radiation onto a sample;

a zone plate lens for collecting the radiation from the sample, wherein a numerical aperture of the capillary tube is matched to the zone plate lens;

a center stop for blocking radiation being transmitted along an axis of the capillary tube;

a pin hole aperture; and a stop support for attaching the center stop to the capillary tube to support the center stop along the axis of the capillary tube.

2. A zone plate microscope as claimed in claim 1, wherein an inner surface of the capillary tube is coated with a reflective material.

3. A zone plate microscope as claimed in claim 1, wherein the center stop is attached to a radiation exit end of the capillary tube by the stop support.

4. A zone plate microscope as claimed in claim 1, further comprising a phase plate, wherein the capillary tube has a pupil aperture that illuminates only part of an aperture of the zone plate lens.

5. A zone plate microscope as claimed in claim 1, wherein the capillary tube has an annular shaped pupil such that a pupil of the zone plate lens is smaller or equal to an inner part of the annular shaped pupil.

6. A zone plate microscope as claimed in claim 1, wherein the capillary tube has an imaging conjugate of unity to minimize image aberration.

7. A zone plate microscope as claimed in claim 1, wherein the capillary tube has a magnifying geometry to achieve suitable illumination of the sample.

8. A zone plate microscope as claimed in claim 1, wherein the stop support comprises a membrane for supporting the center stop along the axis of the capillary tube.

9. A zone plate microscope as claimed in claim 8, wherein the membrane is bonded to an end of the capillary tube.

10. A zone plate microscope, comprising:

an electron bombardment source for generating radiation;

a single capillary tube for receiving and focusing the radiation onto a sample;

a detector;

a zone plate lens for collecting the radiation from the sample and focusing the radiation on the detector;

a center stop for blocking radiation being transmitted along an axis of the capillary tube;

a pin hole stop for blocking radiation between the capillary tube and the detector;

a membrane for supporting the center stop along the axis of the capillary tube;

wherein a numerical aperture of the capillary tube is matched to the zone plate lens and the capillary tube has an annular shaped pupil such that a pupil of the zone plate lens is smaller or equal to an inner part of the annular shaped pupil.

* * * * *